US009731330B1

(12) United States Patent
Kane et al.

(10) Patent No.: US 9,731,330 B1
(45) Date of Patent: Aug. 15, 2017

(54) PORTABLE COOLING TOWER CLEANING SYSTEM

(71) Applicant: Crossford International, LLC, Stamford, CT (US)

(72) Inventors: Timothy J. Kane, Stamford, CT (US); Joseph J. Franzino, Redding, CT (US); Pete Gentile, Whhite Plains, NY (US); Mark Rothenhausen, Stamford, CT (US)

(73) Assignee: Crossford International, LLC, Stamford, CT (US)

( * ) Notice: Subject to any disclaimer, the term of this patent is extended or adjusted under 35 U.S.C. 154(b) by 0 days.

(21) Appl. No.: 14/737,995

(22) Filed: Jun. 12, 2015

(51) Int. Cl.
*B08B 3/02* (2006.01)

(52) U.S. Cl.
CPC ..... *B08B 3/02* (2013.01)

(58) Field of Classification Search
CPC ..... B08B 3/02; F16K 3/246; F16K 3/262
USPC ..... 239/255, 146, 407, 412, 302–379, 239/398–434.5; 137/590
See application file for complete search history.

(56) References Cited

U.S. PATENT DOCUMENTS

| | | | | |
|---|---|---|---|---|
| 820,371 | A | 5/1906 | Skinner et al. | |
| 1,657,013 | A | 1/1928 | Kettle | |
| 2,223,012 | A | 11/1940 | Konwinski et al. | |
| 2,487,348 | A | 8/1944 | Malsbary et al. | |
| 3,606,091 | A | 9/1971 | Grisham | |
| 4,278,132 | A | 7/1981 | Hestetter | |
| 4,286,636 | A | 9/1981 | Credle | |
| 6,345,640 | B1 | 2/2002 | Newberg | |
| 6,705,332 | B2 | 3/2004 | Field et al. | |
| 7,178,740 | B2 * | 2/2007 | Williams | B08B 3/026 239/10 |
| 7,455,246 | B2 | 11/2008 | Roth et al. | |
| 7,500,581 | B2 | 3/2009 | O'Leary et al. | |
| 7,500,584 | B2 | 3/2009 | Schuetz | |
| 7,507,299 | B2 * | 3/2009 | Wadsworth | A61L 2/18 134/22.12 |
| 7,963,463 | B2 | 6/2011 | Breedlove et al. | |
| 8,056,837 | B2 * | 11/2011 | Gardner | B05B 1/02 239/124 |
| 8,425,203 | B2 | 4/2013 | Gardner et al. | |
| 8,485,796 | B2 | 7/2013 | Gilpatrick | |
| 8,555,902 | B2 | 10/2013 | Boehm et al. | |
| 8,814,531 | B2 | 8/2014 | Raasch | |
| 2003/0230522 | A1 | 12/2003 | Pavel | |
| 2004/0217183 | A1 | 11/2004 | Bae et al. | |

(Continued)

FOREIGN PATENT DOCUMENTS

| | | |
|---|---|---|
| EP | 0887122 | 1/2000 |
| GB | 2461731 | 1/2010 |
| WO | WO2011047988 | 4/2011 |

OTHER PUBLICATIONS

"Samurai 100 Carpet Extractor with Wand and Hoses" Jon-Don (http://www.jondon.com/priority-manufacturing-samurai-100-carpet-extractor.html) download date Oct. 14, 2015; 3 pps.

(Continued)

*Primary Examiner* — Arthur O Hall
*Assistant Examiner* — Viet Le
(74) *Attorney, Agent, or Firm* — Carson C. K. Fincham; Fincham Downs, LLC

(57) ABSTRACT

Systems, methods, apparatus, and articles of manufacture for portable cooling tower cleaning are provided.

20 Claims, 7 Drawing Sheets

(56) References Cited

U.S. PATENT DOCUMENTS

| | | | |
|---|---|---|---|
| 2013/0214059 | A1 | 8/2013 | Gilpatrick et al. |
| 2013/0334942 | A1 | 12/2013 | Schestag et al. |
| 2014/0119949 | A1 | 5/2014 | Wischstadt et al. |
| 2014/0251390 | A1 | 9/2014 | Khan et al. |

OTHER PUBLICATIONS

"CoilPro Self Contained Coil Cleaning System" Goodway (http://www.goodway.com/products/coil-cleaning-systems-chemicals/coil-cleaning-machines/coilpro-self-contained-coil-cleaning-system#custom-quicktabs-tab-product_tabs-qt_features) download date Oct. 14, 2015; 2 pps.

* cited by examiner

PORTABLE COOLING TOWER CLEANING SYSTEM

BACKGROUND

Air conditioning and industrial cooling systems typically make use of cooling towers to reject unwanted heat into the atmosphere. While cooling towers of various types may be utilized, wet (or evaporative) cooling towers are generally more efficient at heat removal, and accordingly are quite common in commercial and industrial applications. Such wet cooling towers generally cascade heated water over a "fill" material that provides for an enhanced water-to-air interface, allowing for increased evaporation and heat transfer. Cooled water is collected beneath the fill while heated, saturated air is expelled from the tower, usually via mechanical means such as a fan.

Even when water is filtered or treated, however, the fill material often becomes fouled with scaling and/or biological growth, both of which greatly diminish the ability of the cooling tower to efficiently expel heat. Proper cooling tower maintenance accordingly often includes a pre-rinse of the fill followed by application of chemical cleaners or inhibitors sprayed onto the fill material, and then a final rinse or wash of the fill to remove chemical residue along with dislodged and/or dissolved scale or biological materials. Such maintenance typically includes use of a specialized chemical sprayer to appropriately apply the chemical agents, followed by utilization of a high-pressure power-washing device to rinse and remove debris from the fill material.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Embodiments presented herein are descriptive of systems, methods, apparatus, and articles of manufacture for portable cooling tower cleaning (and components thereof). The inventors have realized, for example, that previously available cooling tower maintenance equipment solutions require multiple pieces of machinery and/or are prone to chemical spillage or mishandling. Most cooling tower equipment, for example, is located on commercial or industrial roofs with limited access. Often, maintenance personnel may need to carry maintenance equipment up ladders or over barriers and access to a water source may be limited and/or require remote connectivity and utilization of lengthy hoses and multiple hose connections. Carrying a chemical sprayer, a power-washer, associated hoses and accessories, and a chemical container to a limited access location is inefficient (may require a single maintenance worker to conduct multiple carry trips), for example, and increases the likelihood of chemical product spillage or mishandling.

In some embodiments described herein, a portable cooling tower cleaning system may comprise an integrated low-flow and/or low-pressure chemical sprayer with a high-flow and/or high-pressure power-washer. The portable cooling tower cleaning system may, for example, house both a low-flow, low-pressure chemical pump and a high-flow, high-pressure power-washing pump, as well as a chemical container. In some embodiments, the chemical container may be interfaced with the system via a specially-designed chemical flow valve assembly that reduces the likelihood of chemical mishandling and spillage.

II. Portable Cooling Tower Cleaning Systems

Figure 1:
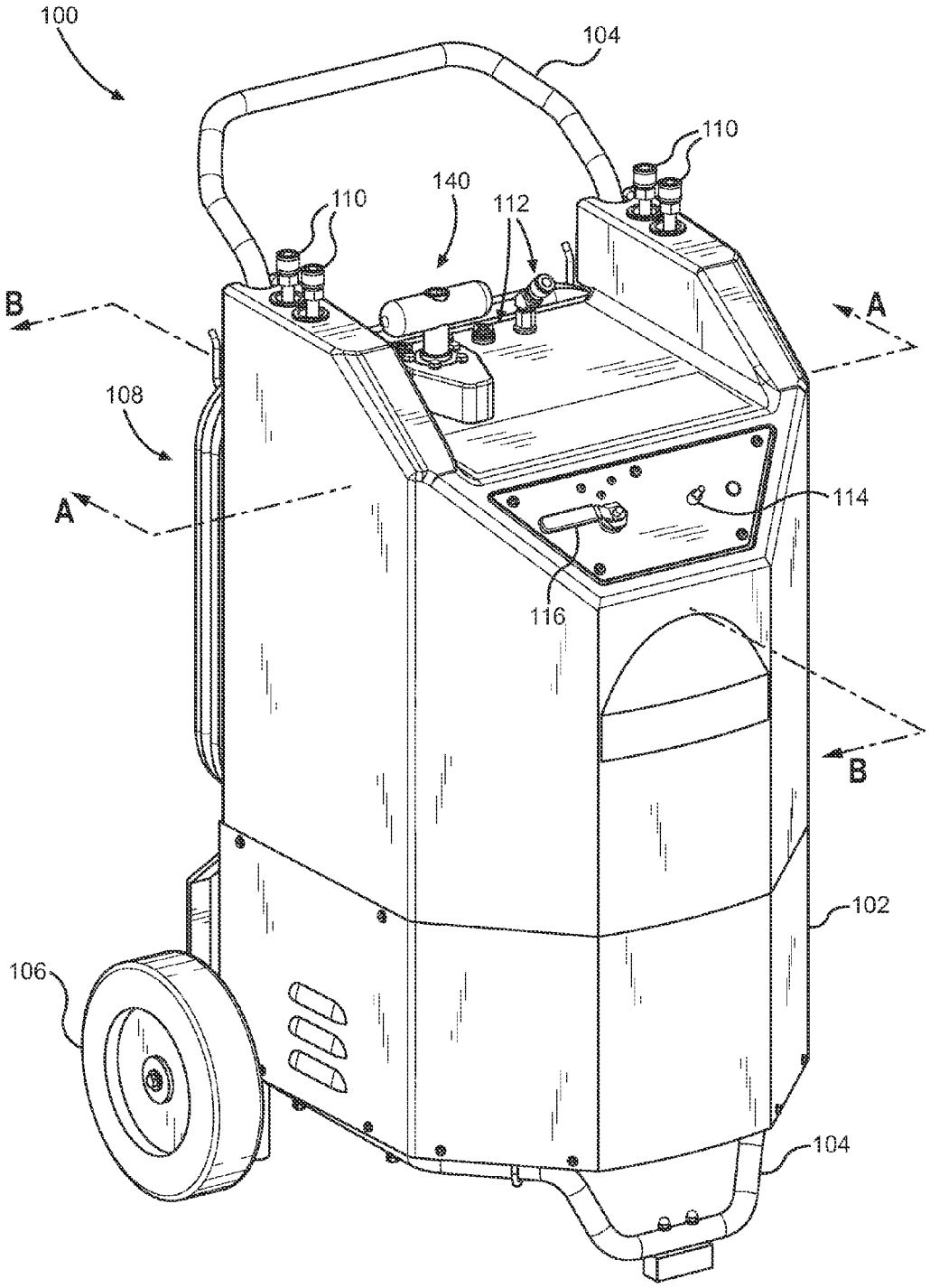
FIG. 1 is an upper, front-right perspective view of a portable cooling tower cleaning system according to some embodiments.

Turning initially to FIG. 1, an upper, front-right perspective view of a portable cooling tower cleaning system 100 according to some embodiments is shown. The portable cooling tower cleaning system 100 may comprise, for example, a housing 102, a frame 104, one or more wheels 106, hose/wire storage 108, extension wands 110, and/or accessory fittings 112. In some embodiments, the portable cooling tower cleaning system 100 may comprise a switch 114 and/or a valve handle 116. In some embodiments, the switch 114 may be utilized to operatively electrically switch the portable cooling tower cleaning system 100 between an "off" mode (e.g., in which components of the portable cooling tower cleaning system 100 are electrically isolated or disengaged), a power-wash or rinse mode (e.g., in which electrical power is switched to engage one or more wash/rinse components of the portable cooling tower cleaning system 100, such as a high-flow and/or high-pressure pump as described herein), and/or a chemical spraying mode (e.g., in which electrical power is switched to engage chemical spraying components of the portable cooling tower cleaning system 100, such as a low-flow and/or low-pressure pump as described herein).

The valve handle 116 may be utilized, in some embodiments, to hydraulically re-configure fluid flow paths (not shown in FIG. 1) within the portable cooling tower cleaning system 100. The valve handle 116 may be utilized, for example, to switch between rinse water and chemical agent flow and/or may be utilized to vary a ratio of wash fluid and chemical agent discharged by the portable cooling tower cleaning system 100.

In some embodiments, the portable cooling tower cleaning system 100 may comprise a chemical flow valve assembly 140. The chemical flow valve assembly 140 may, for example, be selectively engaged in various positions to allow or prevent chemical agent and/or fluids to flow within the portable cooling tower cleaning system 100, and/or may be utilized to seal or unseal a chemical container (not shown in FIG. 1) housed within the housing 102.

According to some embodiments, any or all of the components 102, 104, 106, 108, 110, 112, 114, 116, 140 of the portable cooling tower cleaning system 100 may be similar in configuration and/or functionality to any similarly named and/or numbered components described herein. Fewer or more components 102, 104, 106, 108, 110, 112, 114, 116, 140 (and/or portions thereof) and/or various configurations of the components 102, 104, 106, 108, 110, 112, 114, 116, 140 may be included in the portable cooling tower cleaning system 100 without deviating from the scope of embodiments described herein. In some embodiments, one or more of the various components 102, 104, 106, 108, 110, 112, 114, 116, 140 may not be needed and/or desired in the portable cooling tower cleaning system 100.

Figure 2:
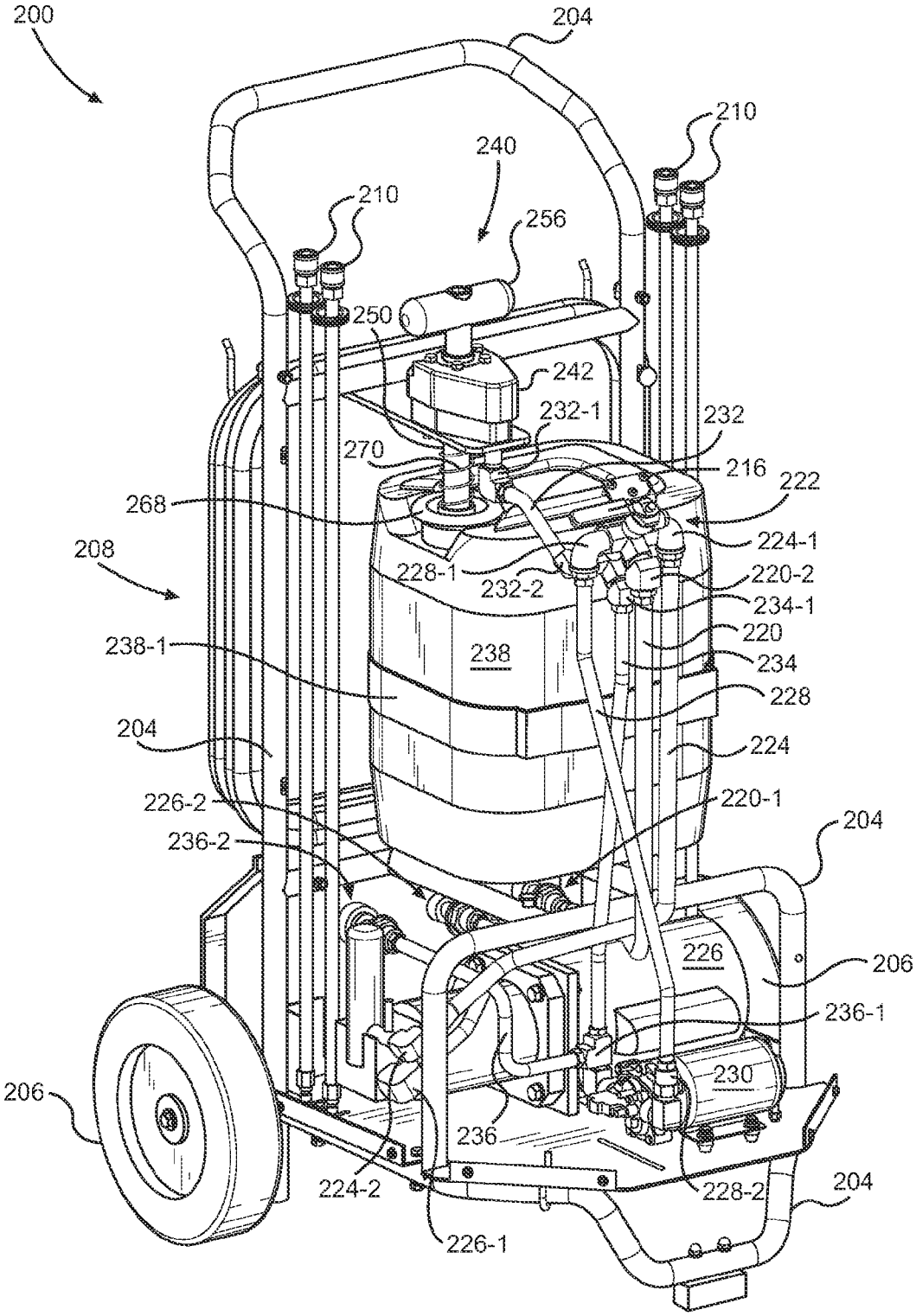
FIG. 2 is an upper, front-right perspective view of internal components of a portable cooling tower cleaning system according to some embodiments.

Referring now to FIG. 2, an upper, front-right perspective view of internal components of a portable cooling tower cleaning system 200 according to some embodiments is shown. In some embodiments, the portable cooling tower cleaning system 200 may be similar in configuration and/or functionality to the portable cooling tower cleaning system 100 of FIG. 1 with the housing 102 thereof removed. According to some embodiments, the portable cooling tower cleaning system 200 may comprise a frame 204, one or more wheels 206, hose/wire storage 208, and/or one or more extension wands 210. In some embodiments, the portable cooling tower cleaning system 200 may comprise a valve handle 216 which is operatively coupled to manage fluid flow within the portable cooling tower cleaning system 200.

In some embodiments for example, the valve handle 216 may be selectively engaged in a first position or setting that permits fluid from a fluid inlet conduit 220 to enter a valve assembly 222 (e.g., a double stacked ball valve assembly as depicted). The fluid may comprise, for example, wash fluid such as water from an external water source (not shown), which enters the portable cooling tower cleaning system 200 via a fluid inlet 220-1 and is directed through the fluid inlet conduit 220 to a fluid valve inlet 220-2, which is coupled to the valve assembly 222. According to some embodiments, the fluid may be directed by the valve assembly 222 to a first fluid outlet conduit 224 via a first fluid valve outlet 224-1 coupled to the valve assembly 222. The fluid may travel through the first fluid outlet conduit 224 to a first fluid outlet 224-2. The first fluid outlet 224-2 may, for example, be coupled to a first pump 226 (and/or component thereof), such as a high-flow and/or high-volume fluid pump. The first pump 226 may, in some embodiments, be configured for a high flow rate of three gallons per minute (3 GPM) at a high pressure of four hundred pounds per square inch (400 psi). In some embodiments, the high flow rate of the first pump 226 may be in the range of two gallons per minute (2 GPM) to four gallons per minute (4 GPM) and/or the high pressure of the first pump 226 may be in the range of three hundred pounds per square inch (300 psi) to five hundred pounds per square inch (500 psi). In some embodiments, the first pump 226 may direct the fluid (e.g., pressurized fluid) via a first pump fluid outlet 226-1 to a high-pressure fluid outlet 226-2. Various hoses, fittings, and/or accessories (such as the extension wands 210, or accessory fittings, and/or nozzles, not shown) may be coupled to the high-pressure fluid outlet 226-2 to utilize the pressurize fluid for rinsing, washing, or power-washing applications (e.g., to pre-wash and/or power-wash cooling tower fill). In some embodiments, for example, an accessory fitting such as an oscillating turbo spray nozzle (not shown in FIG. 2) may be coupled to one or more hoses or extension wands 210 that in turn are coupled to receive pressurized fluid from the high-pressure fluid outlet 226-2 such as to utilize mechanical, pressurized spray action to remove debris from cooling tower fill.

According to some embodiments, the valve handle 212 may be selectively engaged in a second position or setting that permits fluid from the fluid inlet conduit 220 to enter the valve assembly 222, but instead of (or in addition to) being directed to the first fluid outlet conduit 224 via the first fluid valve outlet 224-1, may be directed to a second fluid outlet conduit 228 via a second fluid valve outlet 228-1. The fluid may be directed by the second fluid outlet conduit 228, in some embodiments, to a second fluid outlet 228-2 coupled to a second pump 230, such as a low-flow and/or low-volume fluid pump. The second pump 230 may, in some embodiments, be configured for a low flow rate of one half gallon per minute (0.5 GPM) at a low pressure of two hundred pounds per square inch (200 psi). In some embodiments, the low flow rate of the second pump 230 may be in the range of one quarter gallon per minute (0.25 GPM) to one gallon per minute (1 GPM) and/or the low pressure of the second pump 230 may be in the range of one hundred pounds per square inch (100 psi) to two hundred and fifty hundred pounds per square inch (250 psi). According to some embodiments, a single pump 226/230 (not shown as a single device in FIG. 2) may be selectively configurable to provide both low-flow, low-pressure pumping action as well as high-flow, high-pressure pumping action.

In some embodiments, chemical agent from a chemical inlet conduit 232 (e.g., coupled to a chemical inlet 232-1) may be directed to the valve assembly 222 via a chemical valve inlet 232-2. The valve assembly 222 may direct the chemical agent to a chemical flow conduit 234 via a chemical valve outlet 234-1, for example, and further to a chemical outlet conduit 236. According to some embodiments, the chemical flow conduit 234 may be coupled to the chemical outlet conduit 236 via a fitting 236-1 (e.g., a tee fitting as depicted) and/or the chemical outlet conduit 236 may direct the chemical agent flow to a low-pressure chemical flow outlet 236-2. Various hoses, fittings, and/or accessories (such as the extension wands 210, or accessory fittings, and/or nozzles, not shown) may be coupled to the low-pressure chemical flow outlet 236-2 to utilize the chemical agent flow for applying chemical treatment to cooling tower fill (not shown).

In some embodiments, in the case that the valve handle 212 is selectively engaged in the first position or setting, the portable cooling tower cleaning system 200 may provide high-pressure wash fluid (e.g., via the high-pressure fluid outlet 226-2) and in the case that the valve handle 212 is selectively engaged in the second position or setting, the portable cooling tower cleaning system 200 may provide low-pressure chemical agent (e.g., via the low-pressure chemical flow outlet 226-2). In some embodiments, engagement of the valve handle 212 in various positions between the first and second positions/settings may correspond to various differing ratio settings that cause the portable cooling tower cleaning system 200 to output combined chemical agent and wash fluid flow (e.g., chemical agent at various corresponding levels of dilution)—e.g., via one or more of the high-pressure fluid outlet 226-2 and the low-pressure chemical flow outlet 226-2.

According to some embodiments, the chemical agent flow via the chemical inlet 232-1 may be fed by chemical agent (e.g., a descaling solution such as ScaleBreak-Gel™ available from Goodway Technologies Corporation of Stamford, Conn. and/or a foaming cleaning agent such as Tower-Shine™ High Foaming Fill cleaner, also available from Goodway Technologies Corporation of Stamford, Conn.) stored in a chemical container 238 (e.g., a chemical cleaning/decaling fluid chamber or reservoir). The chemical container 238 may, in some embodiments, be coupled to the frame 204 such as by being removably secured to the frame 204 via a strap 238-1, such that an operator of the portable cooling tower cleaning system 200 may readily insert or remove chemical containers 238 (e.g., swapping out a spent container with a new container; neither of which is separately shown in FIG. 2) with minimal effort. The strap 238-1 may, for example, comprise hook-and-loop securing mechanisms, a ratcheting securing mechanism, and/or other known or available securing mechanisms, none of which are explicitly shown in FIG. 2.

In some embodiments, flow of the chemical agent from the chemical container 238 to the chemical inlet 232-1 may be regulated and/or controlled by a chemical flow valve assembly 240. The chemical flow valve assembly 240 may, for example, comprise a mounting housing 242 coupled to the frame 204. According to some embodiments, the chemical agent may flow (e.g., be drawn) from the chemical container 238 through a dip tube 250 that is slidably coupled through the mounting housing 242. The mounting housing 242 may, for example, hydraulically connect the chemical container 238, via the dip tube 250, to the chemical inlet 232-1. According to some embodiments, the hydraulic connection of the chemical container 238, dip tube 250, and chemical inlet 232-1 may be configured to exist (or be operable) in the case that the dip tube 250 is selectively engaged in a first position, e.g., inserted into the chemical container 238, as shown in FIG. 2. According to some embodiments, a seal 268 coupled to the dip tube 250 may be biased (via a spring 270) against the chemical container 238, causing the chemical container to be sealed (e.g., to reduce splashing and/or to better seat and/or position the dip tube 250, but maintaining communication with the contents of the chemical container and the atmosphere, such as to prevent vacuum formation) in the case that the dip tube 250 is oriented or engaged in the first position as shown in FIG. 2. In some embodiments, the dip tube 250 may be slidably re-configured to be disposed in a second position, such as by manual engagement of a handle 256, where the second position hydraulically isolates the chemical container 238 from the chemical inlet 232-1 (the second position not shown in FIG. 2).

According to some embodiments, any or all of the components 204, 206, 210, 220, 220-1, 220-2, 222, 224, 224-1, 224-2, 226, 226-1, 226-2, 228, 228-1, 228-1, 230, 232, 232-1, 232-2, 234, 234-1, 236, 236-1, 236-2, 238, 238-1, 240, 242, 250, 256, 268, 270 of the portable cooling tower cleaning system 200 may be similar in configuration and/or functionality to any similarly named and/or numbered components described herein. Fewer or more components 204, 206, 210, 220, 220-1, 220-2, 222, 224, 224-1, 224-2, 226, 226-1, 226-2, 228, 228-1, 228-1, 230, 232, 232-1, 232-2, 234, 234-1, 236, 236-1, 236-2, 238, 238-1, 240, 242, 250, 256, 268, 270 (and/or portions thereof) and/or various configurations of the components 204, 206, 210, 220, 220-1, 220-2, 222, 224, 224-1, 224-2, 226, 226-1, 226-2, 228, 228-1, 228-1, 230, 232, 232-1, 232-2, 234, 234-1, 236, 236-1, 236-2, 238, 238-1, 240, 242, 250, 256, 268, 270 may be included in the portable cooling tower cleaning system 200 without deviating from the scope of embodiments described herein. In some embodiments, one or more of the various components 204, 206, 210, 220, 220-1, 220-2, 222, 224, 224-1, 224-2, 226, 226-1, 226-2, 228, 228-1, 228-1, 230, 232, 232-1, 232-2, 234, 234-1, 236, 236-1, 236-2, 238, 238-1, 240, 242, 250, 256, 268, 270 may not be needed and/or desired in the portable cooling tower cleaning system 200.

Figure 3A:
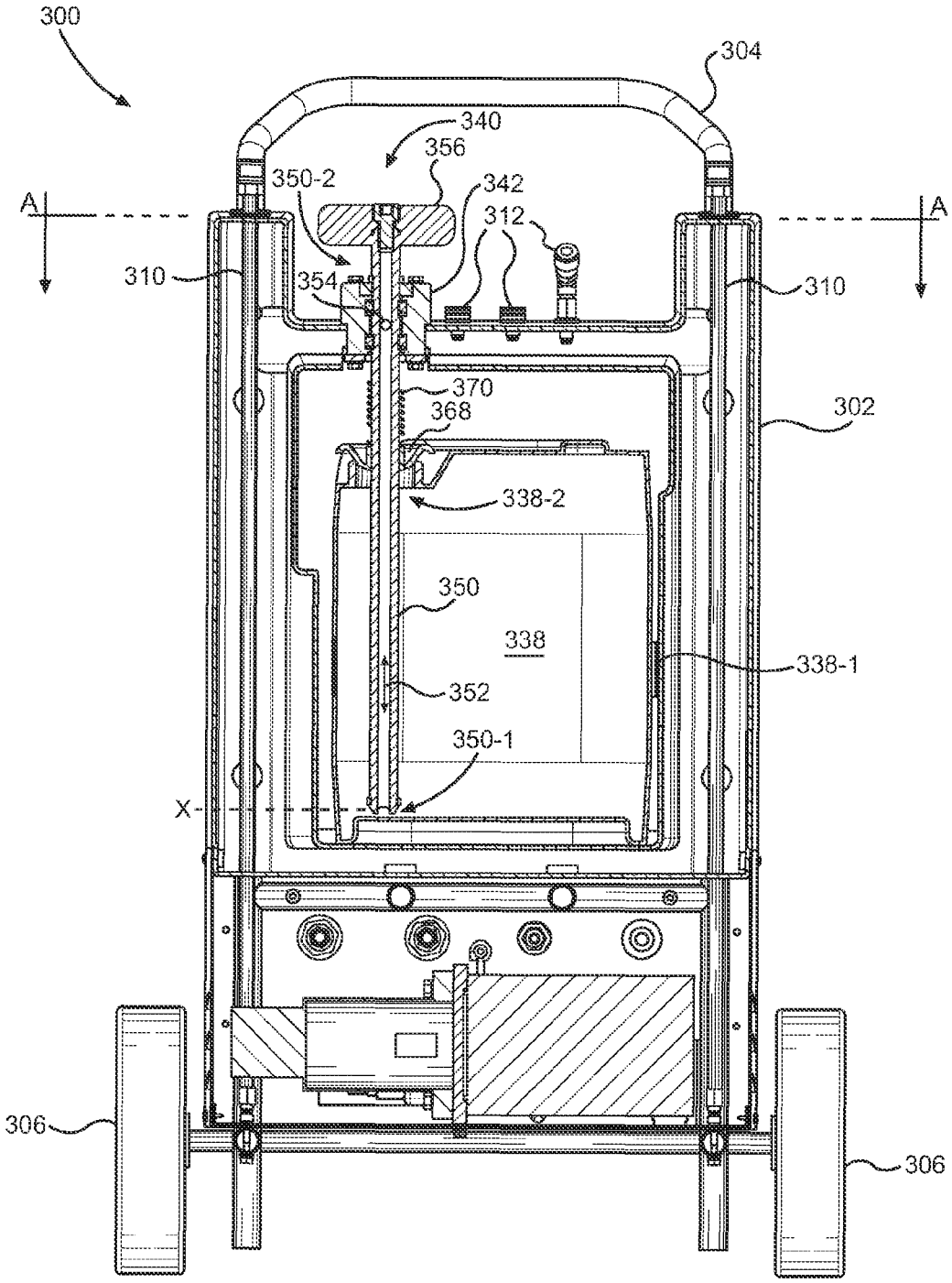
FIG. 3A and FIG. 3B are cross-sectional views of a portable cooling tower cleaning system according to some embodiments.
Figure 3B:
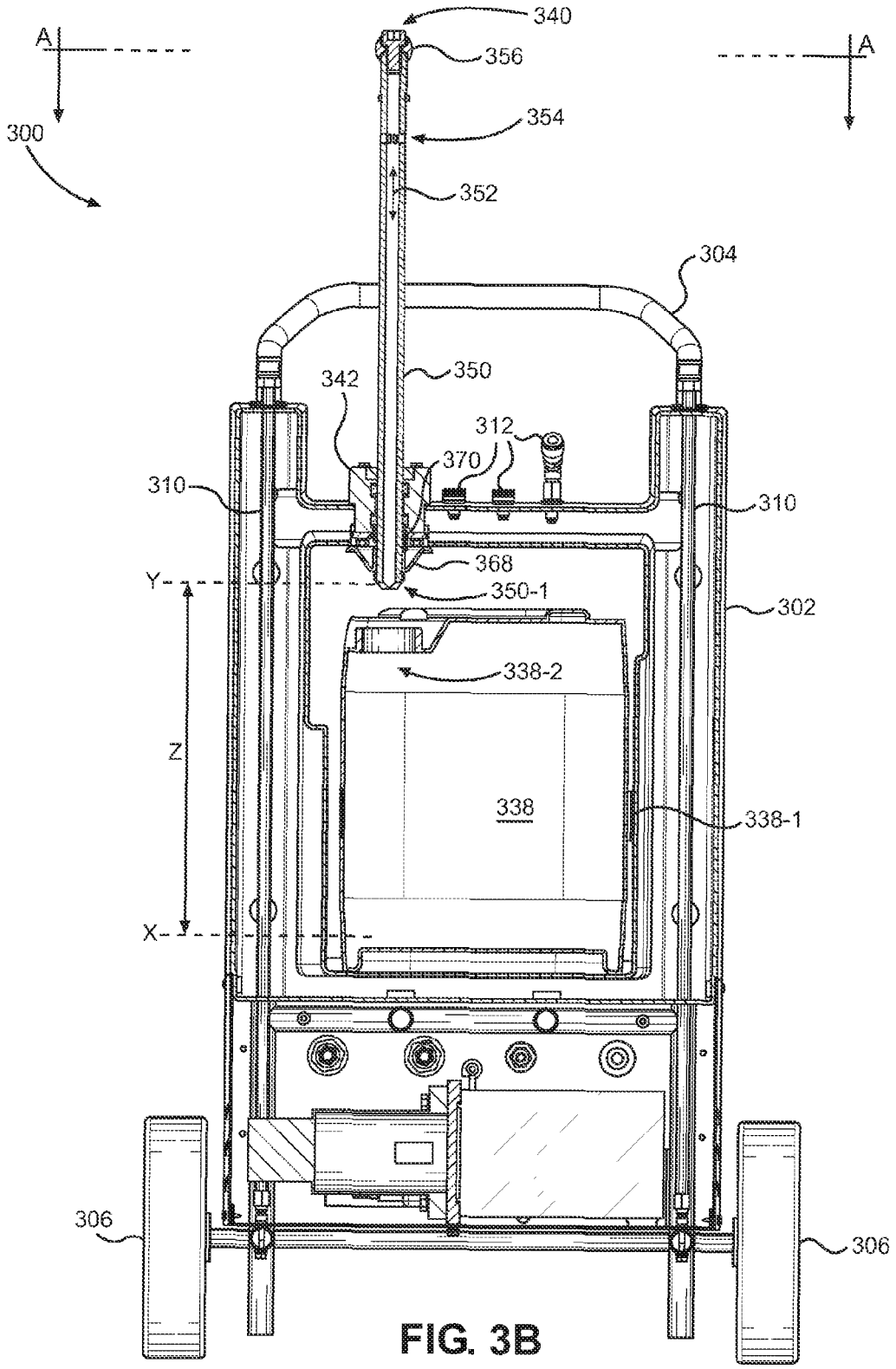

Turning now to FIG. 3A and FIG. 3B, cross-sectional views of a portable cooling tower cleaning system 300 according to some embodiments are shown. According to some embodiments, FIG. 3A and FIG. 3B may comprise cross-sectional views along a cross-section "A" of the portable cooling tower cleaning system 100 of FIG. 1. The portable cooling tower cleaning system 300 may comprise, for example, a housing 302, a frame 304, a plurality of wheels 306, extension wands 310, and/or accessory fittings 312. In some embodiments, the portable cooling tower cleaning system 300 may comprise a chemical container 338 coupled to the frame 304 (and/or housing 302) via a strap 338-1 and the chemical container 338 may comprise an opening 338-2.

According to some embodiments, a chemical flow valve assembly 340 may comprise a mounting housing 342 coupled to the frame 304 (and/or housing 302), through which a tubular portion 350 is inserted. In some embodiments, the tubular portion 350 may comprise an open first end 350-1 and the tubular portion 350 may define an internal chemical flow channel 352 in volumetric communication with the open first end 350-1. In some embodiments, the tubular portion 350 may comprise one or more radial orifices 354, e.g., disposed distally from the open first end 350-1. As depicted in FIG. 3A, the tubular portion 350 of the chemical flow valve assembly 340 may be disposed at a first position denoted by the placement of the open first end 350-1 at the axial position "X" and by the disposition of the one or more radial orifices 354 within the mounting housing 342. According to some embodiments, the tubular portion 350 of the chemical flow valve assembly 340 may be slidably engaged for disposition in one or more other positions (e.g., at least a second position, described with reference to FIG. 3B below) by user engagement of a handle 356 coupled to a second end 350-2 of the tubular portion 350. According to some embodiments, the chemical flow valve assembly 340 may comprise a seal 368 that, in the case the tubular portion 350 is engaged or disposed in the first position depicted in FIG. 3A, is biased against the opening 338-2 of the chemical container 338 by a spring 370. Both the spring 370 and the seal 368 may, for example, be slidably coupled to and/or seated on the outer surface of the tubular portion 350.

According to some embodiments, the seal 368 may provide various advantages with respect to chemical agent transportation, handling, and/or utilization or application. The seal 368 may, for example, wipe chemical agent disposed on the outer diameter of the tubular portion 350 as the seal 368 travels along the tubular portion 350 (e.g., as the tubular portion 350 is moved between positions), thus minimizing dripping of chemical agent. In some embodiments, the seal 368 may act as a splash guard when seated on and/or biased against the chemical container 338 and/or may comprise one or more vents (not explicitly shown) that allow air pressure to equalize between the chemical container 338 and atmosphere, thus preventing vacuum formation from adversely affecting chemical agent flow out of the chemical container 338 and through the tubular portion 350.

In some embodiments, such as depicted in FIG. 3B, the tubular portion 350 may be engaged or disposed at a second position denoted by the placement of the open first end 350-1 at the axial position "Y" and by the disposition of the one or more radial orifices 354 outside of and/or above the mounting housing 342. According to some embodiments, the disposition of the tubular portion 350 in the second position may cause the seal 368 to compress the spring 370 (e.g., against the bottom of the mounting housing 342, one or more portions of the frame 304, and/or the housing 302). In some embodiments, the spring 370 may be compressed between the seal 368 and a biasing plate (not shown) coupled to the housing 302, frame 304, mounting housing 342, and/or tubular portion 350 between the mounting housing 342 and the seal 368. In some embodiments, disposition of the tubular portion 350 in the second position may expose both the open first end 350-1 and the one or more radial orifices 354 to atmospheric air—e.g., the open first end 350-1 is removed from any chemical agent disposed within the chemical container 338 and the one or more radial orifices 354 are removed from within the mounting housing 342. In such a manner, for example, any chemical agent or other fluid in the internal chemical flow channel 352 is permitted to drain, via gravity, back into the chemical container 338. According to some embodiments, a first difference between the first position and the second position of the tubular portion 350 may be expressed in terms of an axial displacement "Z", as depicted. In some embodiments, a second difference between the first position and the second position of the tubular portion 350 may be expressed in terms of radial rotation, such as depicted by the example rotation of the handle 356 by ninety degrees (90°) in FIG. 3B with respect to FIG. 3A. In some embodiments, a locking mechanism (not explicitly shown in FIG. 3A or FIG. 3B) may be provided, such that the tubular portion 350 may be secured and/or locked in one or more of the first, second, or other positions. In some embodiments, the locking mechanism may comprise a bayonet-type securing arrangement such that a rotational displacement of the tubular portion 350 may cause the locking mechanism to be selectively engaged or disengaged.

According to some embodiments, any or all of the components 302, 304, 306, 310, 312, 338, 338-1, 338-2, 340, 342, 350, 350-1, 350-2, 352, 354, 356, 368, 370 of the portable cooling tower cleaning system 300 may be similar in configuration and/or functionality to any similarly named and/or numbered components described herein. Fewer or more components 302, 304, 306, 310, 312, 338, 338-1, 338-2, 340, 342, 350, 350-1, 350-2, 352, 354, 356, 368, 370 (and/or portions thereof) and/or various configurations of the components 302, 304, 306, 310, 312, 338, 338-1, 338-2, 340, 342, 350, 350-1, 350-2, 352, 354, 356, 368, 370 may be included in the portable cooling tower cleaning system 300 without deviating from the scope of embodiments described herein. In some embodiments, one or more of the various components 302, 304, 306, 310, 312, 338, 338-1, 338-2, 340, 342, 350, 350-1, 350-2, 352, 354, 356, 368, 370 may not be needed and/or desired in the portable cooling tower cleaning system 300.

Figure 4A:
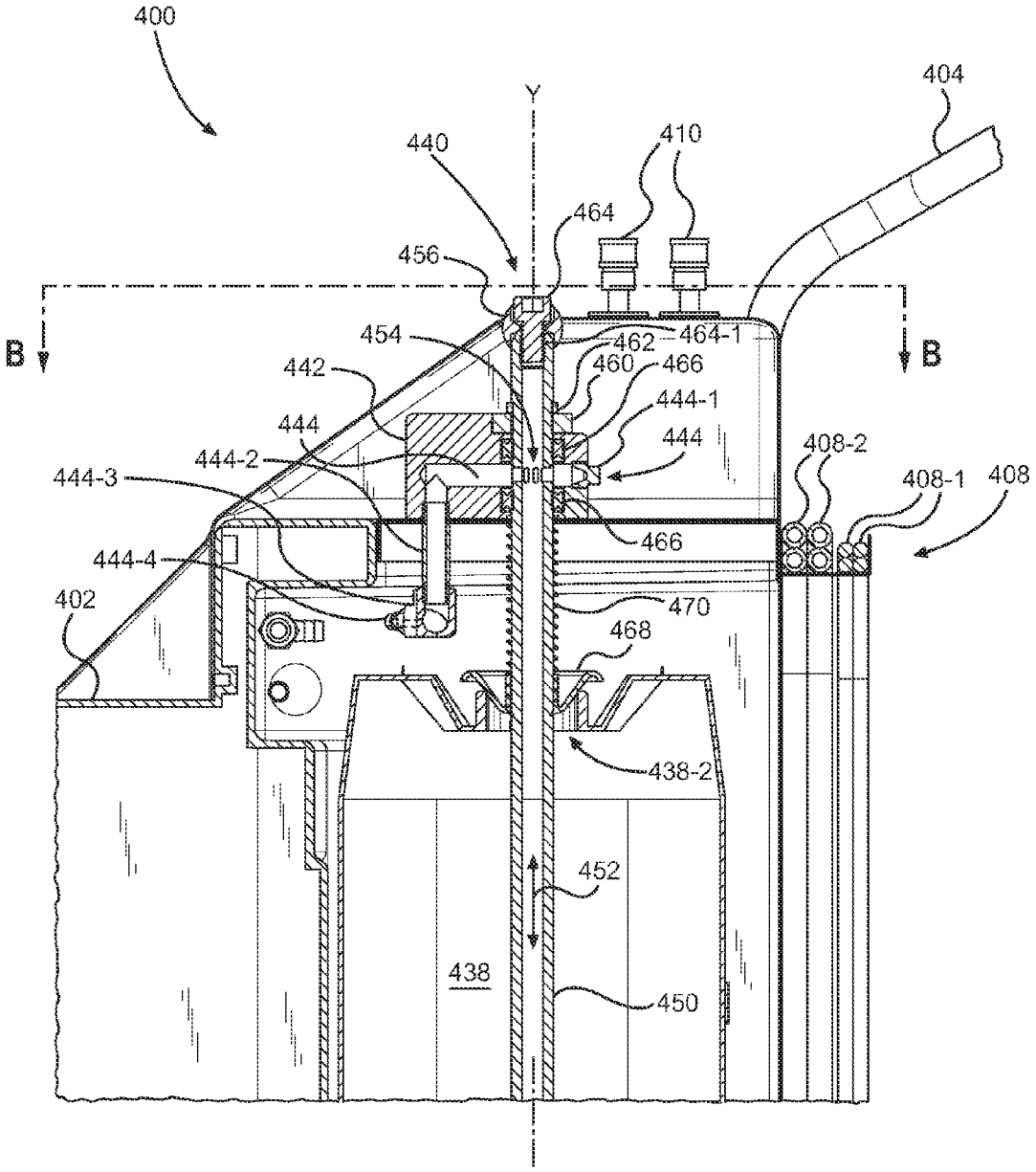
FIG. 4A and FIG. 4B are partial cross-sectional views of a portable cooling tower cleaning system according to some embodiments.
Figure 4B:
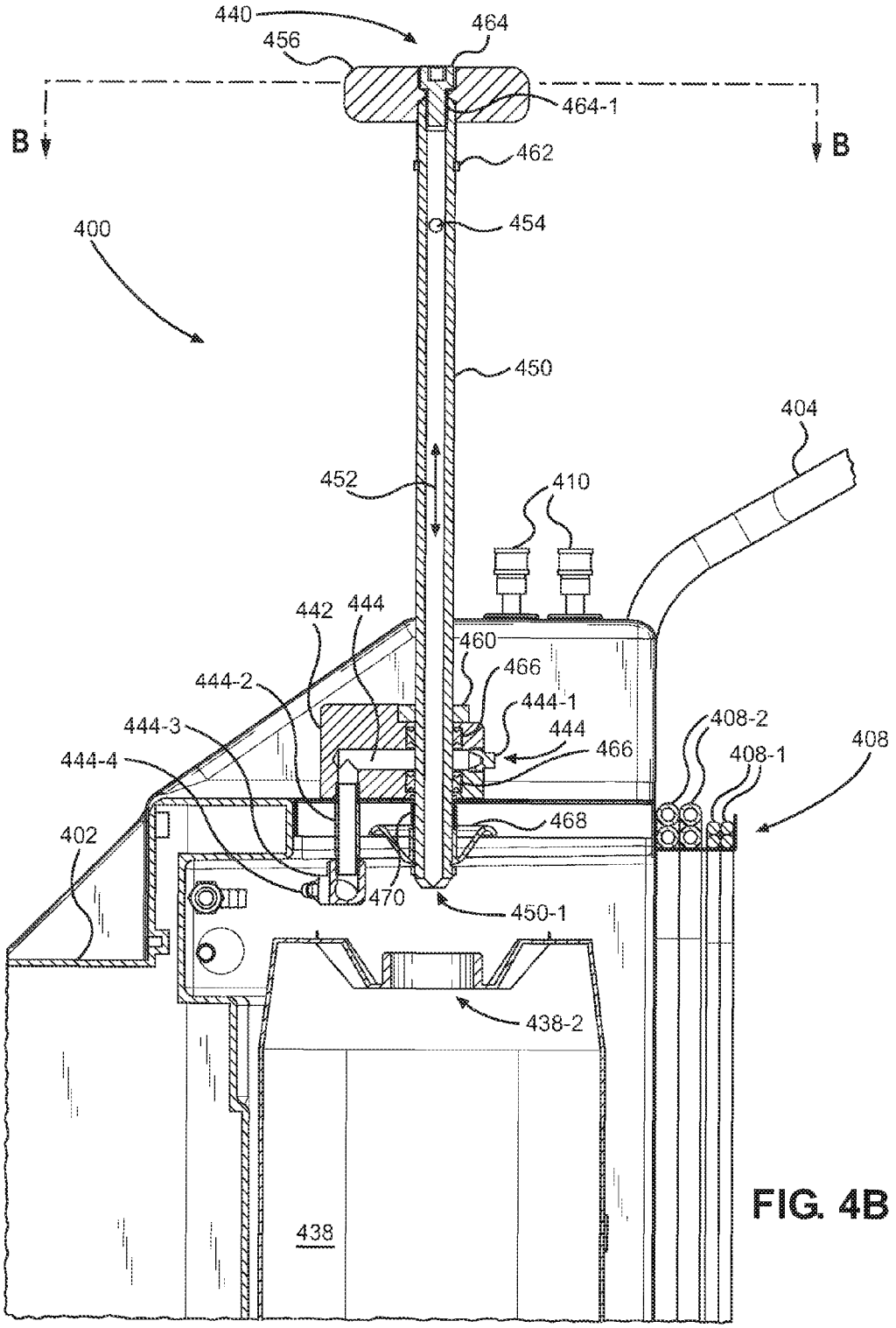

Referring now to FIG. 4A and FIG. 4B, partial cross-sectional views of a portable cooling tower cleaning system 400 according to some embodiments are shown. According to some embodiments, FIG. 4A and FIG. 4B may comprise cross-sectional views along a cross-section "B" of the portable cooling tower cleaning system 100 of FIG. 1. The portable cooling tower cleaning system 400 may comprise, for example, a housing 402, a frame 404, hose/wire storage 408 (e.g., storing electrical wire/cord 408-1 and/or hoses/tubes 408-2), and/or extension wands 410. In some embodiments, the portable cooling tower cleaning system 400 may comprise a chemical container 438 having an opening 438-2.

According to some embodiments, the portable cooling tower cleaning system 400 may comprise a chemical flow valve assembly 440 that may comprise a mounting housing or manifold 442 coupled to the frame 404 (and/or the housing 402). In some embodiments, the manifold 442 may comprise, define, and/or house a chemical flow channel 444 disposed radially to an axis "y". In some embodiments, the chemical flow channel 444 may be disposed horizontally as depicted in FIG. 4A. According to some embodiments, the chemical flow channel 444 may be capped on one end by a plug 444-1 and on an opposite end may be coupled to a pipe segment 444-2, which may in turn be coupled to an elbow 444-3. In some embodiments, the elbow 444-3 may be coupled to a barbed fitting 444-4 that may, for example, be utilized to provide chemical agent and/or fluid flow through one or more hoses, pipes, and/or fittings (none of which are explicitly shown in FIG. 4A), such as for effectuating a chemical spray treatment of cooling tower fill material (also not shown).

In some embodiments, a tubular member 450 may be inserted through the manifold 442 along and/or coincident with the axis "y". The tubular member 450 may, for example, define an internal chemical flow channel 452 oriented axially along the axis "y" and extending through the manifold 442. According to some embodiments, the tubular member 450 may comprise and/or define one or more orifices 454 disposed radially in or on the tubular member 450. As shown in FIG. 4A, the tubular member 450 may be disposed in a first position with respect to the manifold 442 such that the one or more orifices 454 are aligned radially with the chemical flow channel 444. In such a manner, for example, chemical agent and/or fluid may be drawn axially through the internal chemical flow channel 452 from the chemical container 438 and provided radially through the one or more orifices 454 to the chemical flow channel 444. In some embodiments, the tubular member 450 may be repositioned via manually engagement of a handle 456. The handle 456 may be utilized, for example, to slide the tubular member 450 along the axis "y" with respect to the manifold 442 and/or may be utilized to rotate the tubular member 450 about the axis "y" with respect to the manifold 442.

According to some embodiments, the manifold 442 may comprise and/or be coupled to a guide 460 through which the tubular member 450 may be inserted. In some embodiments, the tubular member 450 may comprise and/or be coupled to a stop 462 that may, as depicted in FIG. 4A, be disposed to prevent axial downward movement of the tubular member 450 beyond a certain point by engaging with the guide 460. In some embodiments, the point at which axial downward movement of the tubular member 450 is prevented by the stop 462 and the guide 460 may be defined as the first position of the tubular member 450. According to some embodiments, the handle 456 may be coupled to the tubular member 450 by a coupling member such as a screw 464, e.g., by the screw 464 engaging threads 464-1 disposed on the inner surface of the inside diameter of the tubular member 450. In some embodiments, the manifold 442 may comprise and/or be coupled to one or more annular members 466. The annular members 466 may be disposed within the manifold 442 and coupled to receive the insertion of the tubular member 450, for example. According to some embodiments, the annular members 466 may comprise bearings or bushings coupled to provide a sliding fit for the inserted tubular member 450 and/or allow or facilitate axial rotation thereof. According to some embodiments the annular members 466 may comprise annular seals such as O-rings through which the tubular member 450 is inserted, such that fluid flow through and/or between the one or more orifices 454 and the chemical flow channel 444 may be prevented from leaking out from the manifold 452 at the interface thereof with respect to the tubular member 450. In some embodiments, in the case that the tubular member 450 is positioned in the first position as shown in FIG. 4A, a chemical container seal 468 coupled to the tubular member 450 may be engaged to seal the opening 438-2 of the chemical container 438. A biasing element 470 may be disposed between the chemical container seal 468 and the manifold 442, for example, providing sealing force against the chemical container seal 468 in the direction of the chemical container 438 (e.g., in axially downward direction, as depicted).

In some embodiments, such as depicted in FIG. 4B, the tubular member 450 may be reoriented axially (e.g., in an axially upward direction) to a second position, e.g., by manual engagement of a user with the handle 456. As shown in FIG. 4B, for example, the tubular member 450 has been slid axially upward (with respect to the first position shown in FIG. 4A) through the manifold 442 such that the chemical container seal 468 compresses the biasing element 470 against the manifold 442 (and/or frame 404, housing 402, and/or separate biasing plate—not shown), and open end 450-1 of the tubular portion 450 is removed from the chemical container 438, and the one or more orifices 454 are removed from the manifold 442. In such a manner, for example, the internal chemical flow channel 452 is hydraulically isolated from any chemical agent or fluid disposed in the chemical container 438. According to some embodiments, disposition of the tubular member 450 in the second position hydraulically isolates the internal chemical flow channel 452 from the chemical flow channel 444. In the second position, for example, the one or more orifices 454 are no longer aligned with the chemical flow channel 444 and the chemical flow channel 444 is sealed or interrupted within the manifold 442 by the outer surface of the tubular member 450. As depicted in FIG. 4B (as best seen by the orientation of the handle 456), the tubular member 450 may also or alternatively be rotationally repositioned with respect to the first position shown in FIG. 4A. The handle 456 may be turned, for example, to hydraulically disengage the connection between the one or more orifices 454 and the chemical flow channel 444, to lock the tubular member 450 in one or more of the positions (or other positions), or to unlock the tubular portion 450 from a locking device (not shown), to permit axial and/or rotational reorientation of the tubular member 450.

According to some embodiments, any or all of the components 402, 404, 408, 408-1, 408-2, 410, 438, 438-1, 440, 442, 444, 444-1, 444-2, 444-3, 444-4, 450, 450-1, 452, 454, 456, 460, 462, 464, 464-1, 466, 468, 470 of the portable cooling tower cleaning system 400 may be similar in configuration and/or functionality to any similarly named and/or numbered components described herein. Fewer or more components 402, 404, 408, 408-1, 408-2, 410, 438, 438-1, 440, 442, 444, 444-1, 444-2, 444-3, 444-4, 450, 450-1, 452, 454, 456, 460, 462, 464, 464-1, 466, 468, 470 (and/or portions thereof) and/or various configurations of the components 402, 404, 408, 408-1, 408-2, 410, 438, 438-1, 440, 442, 444, 444-1, 444-2, 444-3, 444-4, 450, 450-1, 452, 454, 456, 460, 462, 464, 464-1, 466, 468, 470 may be included in the portable cooling tower cleaning system 400 without deviating from the scope of embodiments described herein. In some embodiments, one or more of the various components 402, 404, 408, 408-1, 408-2, 410, 438, 438-1, 440, 442, 444, 444-1, 444-2, 444-3, 444-4, 450, 450-1, 452, 454, 456, 460, 462, 464, 464-1, 466, 468, 470 may not be needed and/or desired in the portable cooling tower cleaning system 400.

Figure 5:
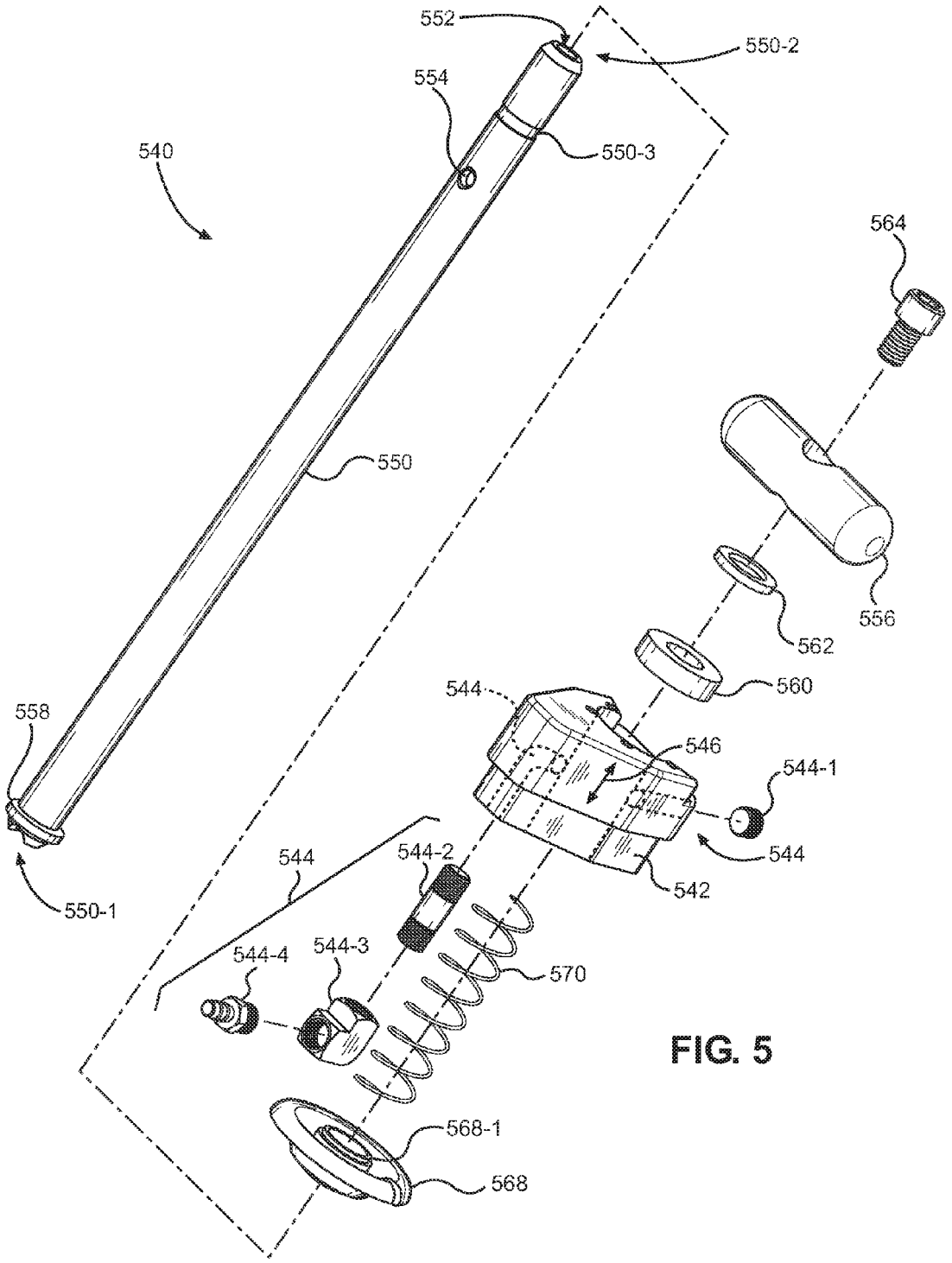
FIG. 5 is an exploded perspective view of a chemical flow valve assembly according to some embodiments.

Turning to FIG. 5, an exploded perspective view of a chemical flow valve assembly 540 according to some embodiments is shown. In some embodiments, the chemical flow valve assembly 540 may comprise a mounting housing or manifold 542 that defines, houses, and/or is coupled to a radial chemical flow channel 544. The radial chemical flow channel 544 may, for example, be disposed transverse to and/or cross through a cylindrical void 546 of the manifold 542 disposed along an assembly axis as shown in FIG. 5. In some embodiments, the radial chemical flow channel 544 may be capped or plugged on a first side of the manifold 542 with a plug fitting 544-1. According to some embodiments, the radial chemical flow channel 544 may comprise one or more threaded extensions 544-2, elbow fittings 544-3, and/or barbed fittings 544-4, such as for attaching to various hoses, pipes, and/or tubes (not shown) for chemical spray applications such as cooling tower fill treatment.

In some embodiments, the chemical flow valve assembly 540 may comprise a tubular portion 550 having a first end 550-1 and a second end 550-2 opposite from the first end 550-1. According to some embodiments, the first end 550-1 may be open to an interior chemical flow channel 552 defined by a hollow configuration of the tubular portion 550. In some embodiments, the tubular portion 550 may comprise a recess 550-3 disposed on the outer surface of the tubular portion 550 proximate to the second end 550-2. According to some embodiments, the tubular portion 550 may comprise a radial orifice or bore 554 disposed proximate to the second end 550-2 and in volumetric communication with the interior chemical flow channel 552. As shown in FIG. 5, in some embodiments the recess 550-3 may be disposed between the radial bore 554 and the second end 550-2. In some embodiments, the tubular portion 550 may comprise and/or be coupled to a handle 556 (e.g., at the second end 550-2) and/or may comprise a stop flange 558 formed, disposed, and/or coupled proximate to the first end 550-1. In some embodiments, the tubular portion 550 may be inserted into and/or through the manifold 542, such as through the cylindrical void 546.

According to some embodiments, the chemical flow valve assembly 540 (and/or the manifold 542) may comprise a guide 560 coupled to an upper portion of the manifold 542. The guide 560 may comprise, as depicted in FIG. 5 for example, an annular member through which the tubular portion 550 may be inserted. In some embodiments, a stop 562 may be coupled to the tubular member 550 such as at the recess 550-3 thereof. The stop 562 may, in some embodiments, comprise a ring or annular element coupled to and around the outer surface of the tubular portion 550. In such a manner, for example, in the case that the tubular portion 550 is slidably reoriented within the cylindrical void 546, the stop 562 will engage with the guide 560 in the case that the recess 550-3 of the tubular portion 550 is oriented proximate to the guide 560, thereby preventing downward axial movement of the tubular portion 550 through the cylindrical void 560 beyond a certain predefined point (e.g., alignment of a bottom surface of the stop 562 with an upper surface of the guide 560).

In some embodiments, the handle 556 may be attached to the tubular member 550 via a screw 564, e.g., threaded into a portion of the interior chemical flow channel 552 at the second end 550-2 of the tubular member 550. According to some embodiments, a chemical container seal 568 may be coupled to the tubular member 550. As depicted in FIG. 5, for example, the chemical container seal 568 may comprise an annular sealing element through which the tubular member 550 may be inserted. In some embodiments, the chemical container seal 568 may rest on, be stopped or retained by, and/or be biased against the stop flange 558. A biasing element such as a compression spring 570 may, for example, be slid over the tubular portion 550 such that it is disposed between the manifold 542 and the chemical container seal 568. In some embodiments, the chemical container seal 568 may comprise a spring seat 568-1 that seats or retains the spring 570.

According to some embodiments, any or all of the components 542, 544, 544-1, 544-2, 544-3, 544-4, 546, 550, 550-1, 550-2, 550-3, 552, 554, 556, 558, 560, 562, 564, 568, 568-1, 570 of the chemical flow valve assembly 540 may be similar in configuration and/or functionality to any similarly named and/or numbered components described herein. Fewer or more components 542, 544, 544-1, 544-2, 544-3, 544-4, 546, 550, 550-1, 550-2, 550-3, 552, 554, 556, 558, 560, 562, 564, 568, 568-1, 570 (and/or portions thereof) and/or various configurations of the components 542, 544, 544-1, 544-2, 544-3, 544-4, 546, 550, 550-1, 550-2, 550-3, 552, 554, 556, 558, 560, 562, 564, 568, 568-1, 570 may be included in the chemical flow valve assembly 540 without deviating from the scope of embodiments described herein. In some embodiments, one or more of the various components 542, 544, 544-1, 544-2, 544-3, 544-4, 546, 550, 550-1, 550-2, 550-3, 552, 554, 556, 558, 560, 562, 564, 568, 568-1, 570 may not be needed and/or desired in the chemical flow valve assembly 540.

III. Conclusion

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant(s) reserves the right to file additional applications to pursue patents for subject matter that has been disclosed and enabled, but not claimed in the present application.

What is claimed is:

1. A chemical flow valve assembly, comprising:

a housing defining a cylindrical void disposed along an axis;

a chemical flow conduit coupled to the housing and defining a radial chemical flow channel through the cylindrical void;

a tubular portion slidably coupled to the housing and disposed within the cylindrical void and axially oriented along the axis, the tubular portion defining an interior chemical flow channel along the axis, and the tubular portion comprising an open first end and at least one radial orifice disposed distal from the first end;

wherein the tubular portion is operative to be selectively oriented in:

(i) a first axial position within the cylindrical void, such that an outer surface of the tubular portion seals the radial chemical flow channel and both the open first end and the at least one radial orifice of the tubular portion are in communication with atmospheric air; and (ii) a second axial position within the cylindrical void, such that the open end is disposed within a chemical fluid volume and the at least one orifice is aligned with the radial chemical flow channel such that chemical fluid received from the chemical fluid volume by the open end of the tubular portion is in fluid communication with, via the interior chemical flow channel and the at least one orifice, the radial chemical flow channel.

2. The chemical flow valve assembly of claim 1, further comprising:

a handle coupled to a second end of the tubular portion, the second end being opposite from the first end.

3. The chemical flow valve assembly of claim 1, wherein a difference between the first axial position and the second axial position comprises an axial displacement of the tubular portion within the cylindrical void.

4. The chemical flow valve assembly of claim 1, wherein a difference between the first axial position and the second axial position comprises a rotational displacement of the tubular portion within the cylindrical void.

5. The chemical flow valve assembly of claim 4, wherein rotational displacement is ninety degrees.

6. The chemical flow valve assembly of claim 1, further comprising:

a chemical container seal slidably coupled to the exterior of the tubular portion such that in the case that the tubular portion is selectively oriented in the second axial position the chemical container seal engages with an opening of the chemical fluid volume.

7. The chemical flow valve assembly of claim 6, further comprising:

a biasing plate coupled to the exterior of the tubular portion; and a compression spring element defining an internal passage through which the tubular portion is inserted, the compression spring element seating, at a first end thereof, against the biasing plate and the compression spring element seating, at a second end thereof, against the chemical container seal.

8. The chemical flow valve assembly of claim 7, wherein in the case that the tubular portion is selectively oriented in the second axial position, the compression spring element is compressed, biasing the chemical container seal against the opening of the chemical fluid volume.

9. The chemical flow valve assembly of claim 6, further comprising:

a compression spring element defining an internal passage through which the tubular portion is inserted, the compression spring element seating, at a first end thereof, against the housing and the compression spring element seating, at a second end thereof, against the chemical container seal.

10. The chemical flow valve assembly of claim 1, further comprising:

a locking mechanism configured to secure the tubular portion in at least one of the first and second axial positions.

11. A portable chemical washing system, comprising:

a frame;

a housing coupled to the frame;

a chemical cleaning fluid conduit coupled to deliver chemical cleaning fluid from a chemical cleaning fluid chamber to a chemical cleaning fluid outlet;

a first fluid pump, the first fluid pump comprising a low-flow, low-pressure pump coupled to pressurize flow of chemical cleaning fluid through the chemical cleaning fluid conduit;

a high-pressure wash fluid conduit disposed within the housing and coupled to deliver wash fluid from a wash fluid source to a wash fluid outlet; and a second fluid pump disposed within the housing, the second fluid pump comprising a high-flow, high-pressure pump coupled to pressurize flow of the wash fluid through the wash fluid conduit;

a chemical flow valve assembly coupled to the frame, the chemical flow valve assembly comprising:

a mounting housing defining a cylindrical void disposed along an axis, the mounting housing coupled to the frame and the chemical cleaning fluid conduit coupled to the mounting housing and defining a radial chemical flow channel through the cylindrical void; and a tubular portion slidably coupled to the mounting housing and disposed within the cylindrical void and axially oriented along the axis, the tubular portion defining an interior chemical flow channel along the axis, and the tubular portion comprising an open first end and at least one radial orifice disposed distal from the first end;

wherein the tubular portion is operative to be selectively oriented in:

(i) a first axial position within the cylindrical void, such that an outer surface of the tubular portion seals the radial chemical flow channel and both the open first end and the at least one radial orifice of the tubular portion are in communication with atmospheric air; and (ii) a second axial position within the cylindrical void, such that the open end is disposed within the chemical cleaning fluid chamber and the at least one orifice is aligned with the radial chemical flow channel such that chemical cleaning fluid received from the chemical cleaning fluid chamber by the open end of the tubular portion is in fluid communication with, via the interior chemical flow channel and the at least one orifice, the radial chemical flow channel.

12. The portable chemical washing system of claim 11, wherein the chemical flow valve assembly further comprises:

a handle coupled to a second end of the tubular portion, the second end being opposite from the first end.

13. The chemical flow valve assembly of claim 11, wherein a difference between the first axial position and the second axial position comprises an axial displacement of the tubular portion within the cylindrical void.

14. The chemical flow valve assembly of claim 11, wherein a difference between the first axial position and the second axial position comprises a rotational displacement of the tubular portion within the cylindrical void.

15. The chemical flow valve assembly of claim 14, wherein rotational displacement is ninety degrees.

16. The chemical flow valve assembly of claim 11, further comprising:

a chemical cleaning fluid chamber seal slidably coupled to the exterior of the tubular portion such that in the case that the tubular portion is selectively oriented in the second axial position the chemical cleaning fluid chamber seal engages with an opening of the chemical cleaning fluid chamber.

17. The chemical flow valve assembly of claim 16, further comprising:

a biasing plate coupled to the exterior of the tubular portion; and a compression spring element defining an internal passage through which the tubular portion is inserted, the compression spring element seating, at a first end thereof, against the biasing plate and the compression spring element seating, at a second end thereof, against the chemical cleaning fluid chamber seal.

18. The chemical flow valve assembly of claim 17, wherein in the case that the tubular portion is selectively oriented in the second axial position, the compression spring element is compressed, biasing the chemical cleaning fluid chamber seal against the opening of the chemical cleaning fluid chamber.

19. The portable chemical washing system of claim 11, wherein at least one of the chemical cleaning fluid conduit and the first fluid pump are disposed within the housing.

20. The portable chemical washing system of claim 11, further comprising:

an oscillating nozzle coupled to the wash fluid outlet.

* * * * *